US005291737A

United States Patent [19]

Camberlein et al.

[11] Patent Number: 5,291,737

[45] Date of Patent: Mar. 8, 1994

[54] PROCESS OR APPARATUS FOR DISTILLING AIR AND APPLICATION IN FEEDING GAS TO A STEEL MILL

[75] Inventors: Francois Camberlein, Paris, France; Jean-Louis Girault, Liege, Belgium; Philippe Mazieres, Montfermeil; Jean-Pierre Tranier, Paris, both of France

[73] Assignee: L'Air Liquide, Societe Anonyme Pour L'Etude et L'Exploitation Des Procedes Georges Claude, Paris, France

[21] Appl. No.: 923,336

[22] Filed: Jul. 31, 1992

[30] Foreign Application Priority Data

Aug. 7, 1991 [FR] France ..... 91 10035

[51] Int. Cl.[5] ..... F25J 3/04

[52] U.S. Cl. ..... 62/22; 62/41

[58] Field of Search ..... 62/24, 38, 39, 22, 41

[56] References Cited

U.S. PATENT DOCUMENTS

| | | | |
|---|---|---|---|
| 4,529,425 | 7/1985 | McNeil | 62/39 |
| 4,595,405 | 6/1986 | Agrawal et al. | 62/38 |
| 4,824,453 | 4/1989 | Rottmann et al. | 62/24 |
| 5,079,923 | 1/1992 | Grenier | 62/24 |
| 5,144,808 | 9/1992 | Ha | 62/24 |

FOREIGN PATENT DOCUMENTS

| | | |
|---|---|---|
| 1314605 | 12/1963 | France . |
| 2169561 | 9/1973 | France . |

*Primary Examiner*—Ronald C. Capossela

*Attorney, Agent, or Firm*—Curtis, Morris & Safford

[57] ABSTRACT

The apparatus is of the type having a double column and a mixing column. The latter is fed at the bottom portion with auxiliary air that is compressed at a pressure different from that of the mean pressure column, and at the top by means of a liquid withdrawn from the bottom of the low pressure column and pumped at the same pressure as the auxiliary air. Impure oxygen is withdrawn at the top of the mixing column as production gas, and substantially pure oxygen is produced at the bottom of the low pressure column.

13 Claims, 3 Drawing Sheets

PROCESS OR APPARATUS FOR DISTILLING AIR AND APPLICATION IN FEEDING GAS TO A STEEL MILL

BACKGROUND OF THE INVENTION (a) Field of the Invention

The present invention relates to the technology of air distillation.

(b) Description of Prior Art

Some industrial applications require important quantities of impure oxygen under various pressures: gasifying of carbon, gasifying of petroleum residues, direct reduction-melting of iron minerals, injection of carbon in blast furnaces, metallurgy of non-ferrous metals, etc.

On the other hand, some industrial applications require the simultaneous supplying, in large quantities, of practically pure oxygen and of impure oxygen under different pressures. This is for example the case of steel mills having oxygen converters and in which the blast furnace is supplied with oxygen or oxygen enriched air.

The invention aims at fulfilling such means in an economical manner, i.e. permitting, with relatively low investment and energy consumption, to produce impure oxygen at a purity and a pressure which are selected at will and, if necessary, the production of practically pure oxygen.

SUMMARY OF THE INVENTION

For this purpose, it is an object of the invention to provide a process for distilling air by means of a double distillation column coupled to a mixing column, in which the mixing column is supplied at the bottom with an auxiliary gas consisting of a mixture of air gases, and at the top with a liquid richer in oxygen than the auxiliary gas, withdrawn in the lower part of the low pressure column, impure oxygen constituting a production gas is withdrawn from the top of the mixing column, where the auxiliary gas and the liquid feeding the mixing column are compressed at a same pressure that differs from that of the mean pressure column, typically higher than the latter, advantageously at least $2\times10^5$ Pa.

Said liquid may be the liquid of the bottom of the low pressure column, for example oxygen practically free of nitrogen, or may be withdrawn a few plates from the bottom of the low pressure column.

Within the framework of such process, it is additionally possible to produce argon by means of an additional distillation column for the production of impure argon which is coupled to the low pressure column.

It is also an object of the invention to provide an apparatus for distilling air, adapted for carrying out the process defined above, of the type comprising a double distillation column, a mixing column, a heat exchange line, a source of auxiliary gas consisting of a mixture of air gases, means to introduce the auxiliary gas at the bottom of the mixing column, means for withdrawing a liquid richer in oxygen than the auxiliary gas from the lower part of the low pressure column, means for pumping this liquid and introducing same at the top of the mixing column, and means for withdrawing impure oxygen from the top of the mixing column as a production gas for the apparatus, characterized in that it comprises means for compressing the auxiliary gas at a given pressure that is different from that of the mean pressure column, ducts for this compressed auxiliary gas provided in the heat exchange line and in that the pumping means bring the liquid at said given pressure.

It is also an object of the invention to provide for the application of the process defined above to the gas which is fed to a steel mill, said impure oxygen being produced under the pressure of the blast furnace and being sent to the latter.

When said liquid is oxygen which is practically free of nitrogen, advantageously, said oxygen practically free of nitrogen is sent to converters of the steel mill.

BRIEF DESCRIPTION OF DRAWINGS

Examples of the invention will now be described with reference to the annexed drawings, in which.

DESCRIPTION OF PREFERRED EMBODIMENTS

Figure 1:
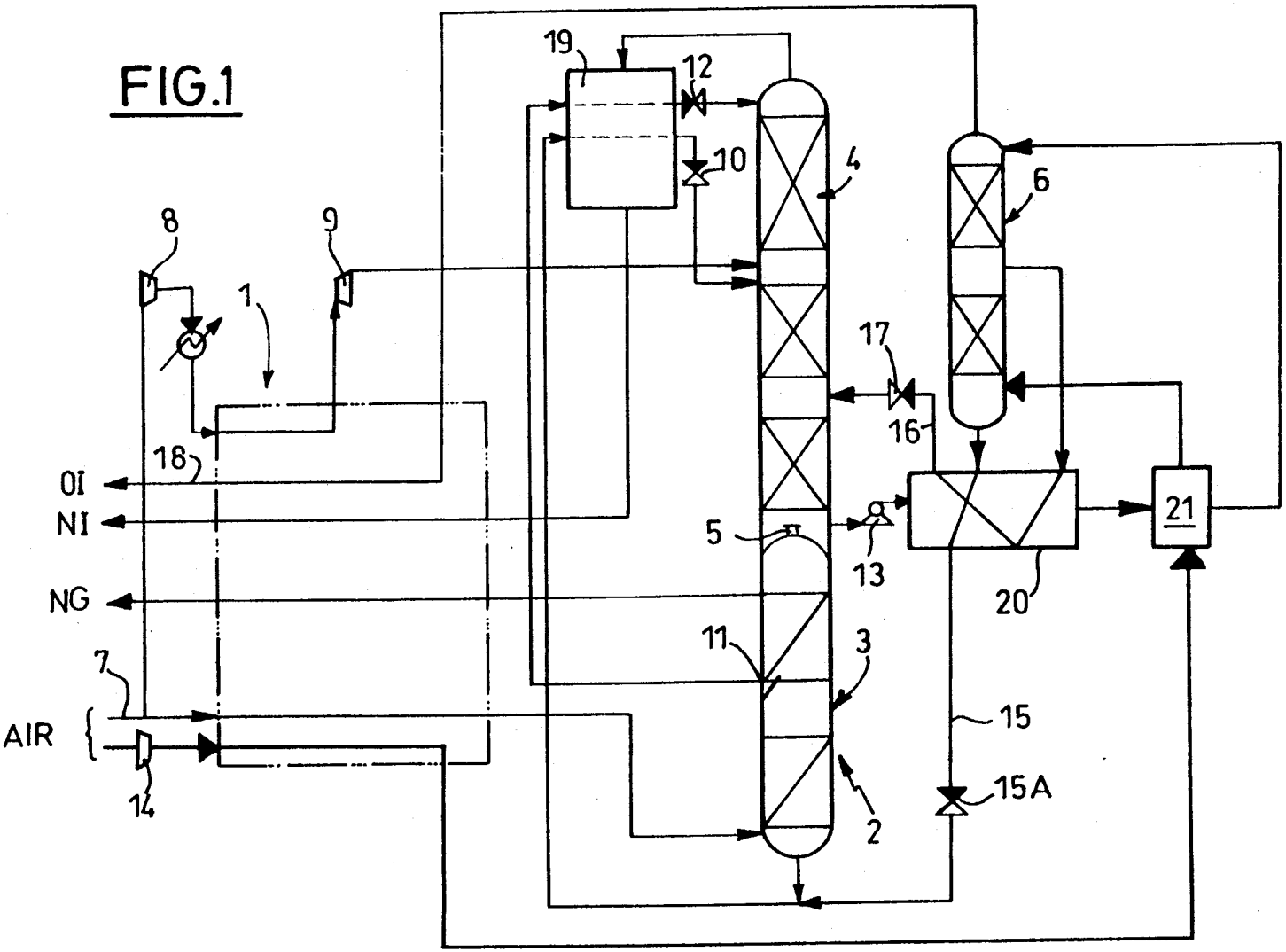
FIGS. 1 to 3 are schematic representations of three embodiments of the apparatus for distilling air according to the invention.

The apparatus for distilling air represented in FIG. 1 is adapted to produce impure oxygen, for example at a purity of 80 to 97% and preferably 85 to 95%, under a clearly different given pressure P of $6\times10^5$ Pa abs., for example under 2 to $5\times10^5$ Pa or advantageously under a pressure higher by at least $2\times10^5$ Pa and which may be as high as about $10\times10^5$ Pa, preferably between $8\times10^5$ Pa and $15\times10^5$ Pa. The apparatus essentially comprises a heat exchange line 1, a double distillation column 2 itself comprising a mean pressure column 3, a low pressure column 4 and a main condenser-vaporizer 5, and a mixing column 6. Columns 3 and 4 typically operate under about $6\times10^5$ Pa and about $1\times10^5$ Pa, respectively.

As explained in detail in the document U.S. Pat. No. 4,022,030, a mixing column is a column that has the same structure as a distillation column but which is used for mixing a relatively volatile gas in a manner that is close to reversibility, such gas being introduced at its bottom, and a less volatile liquid, which is introduced at the top.

Such a mixture produces refrigerating energy and therefore enables to reduce the consumption of energy associated with distillation. In the present case, this mixture is used, additionally, to directly produce impure oxygen under pressure P, as it will be described hereinbelow.

The air to be separated by distillation, compressed at $6\times10^5$ Pa and suitably purified, is sent to the bottom of the mean pressure column 3 by means of a duct 7. The major part of this air is cooled in heat exchange line 1 and is introduced at the bottom of the mean pressure column 3, and the remainder, which is overpressurized at 8 and cooled, is expanded at low pressure in a turbine 9 associated to a booster 8, and then is blown at an intermediate location of the low pressure column 4. After expansion in an expansion valve 10, "rich liquid" (oxygen enriched air) withdrawn from the bottom of column 3 is introduced into column 4, at the vicinity of the location where air is blown in. After expansion in an expansion valve 12, "poor liquid" (impure nitrogen) withdrawn from an intermediate point 11 of column 3 is introduced at the top of column 4, constituting the residual gas of the apparatus, and pure gaseous nitrogen under the medium pressure produced at the top of column 3, are warmed in the exchange line 1 and are withdrawn from the apparatus. The gases are respectively indicated by NI and NG on FIG. 1

Liquid oxygen, more or less pure depending on the setting of the double column 2, is withdrawn from the bottom of column 4, pressurized by means of a pump 13 at a pressure P1, slightly higher than pressure P mentioned above to account for losses of charge (P1-P lower than $1\times10^5$ Pa), and introduced at the top of column 6. P1 is therefore advantageously between $8\times10^5$ Pa and $30\times10^5$ Pa, preferably between $8\times10^5$ Pa and $16\times10^5$ Pa. Auxiliary air, compressed at the same pressure P1 by means of an auxiliary compressor 14 and cooled in exchange line 1, is introduced at the bottom of mixing column 6. From the latter three flows of fluid are withdrawn: at the bottom, a liquid neighboring rich liquid and combined with the latter via duct 15 provided with an expansion valve 15A; at an intermediate point, a mixture essentially consisting of oxygen and nitrogen, which is sent to an intermediate point of the low pressure column 4 via duct 16 provided with an expansion valve 17; at the top, impure oxygen, which after warming in the heat exchange line, is withdrawn, substantially at pressure P, from the apparatus via duct 18 as a production gas OI.

FIG. 1 also illustrates auxiliary heat exchangers 19, 20, 21 ensuring the recovery of the cold that is available in the fluids which are circulated in the apparatus.

As it would be understood, the presence of a separate circuit for the auxiliary air that feeds column 6, enables to choose at will the pressure P of the impure oxygen which is produced. Moreover, as indicated above, the setting of the double column enables to obtain various degrees of purity for this gas.

Figure 2:
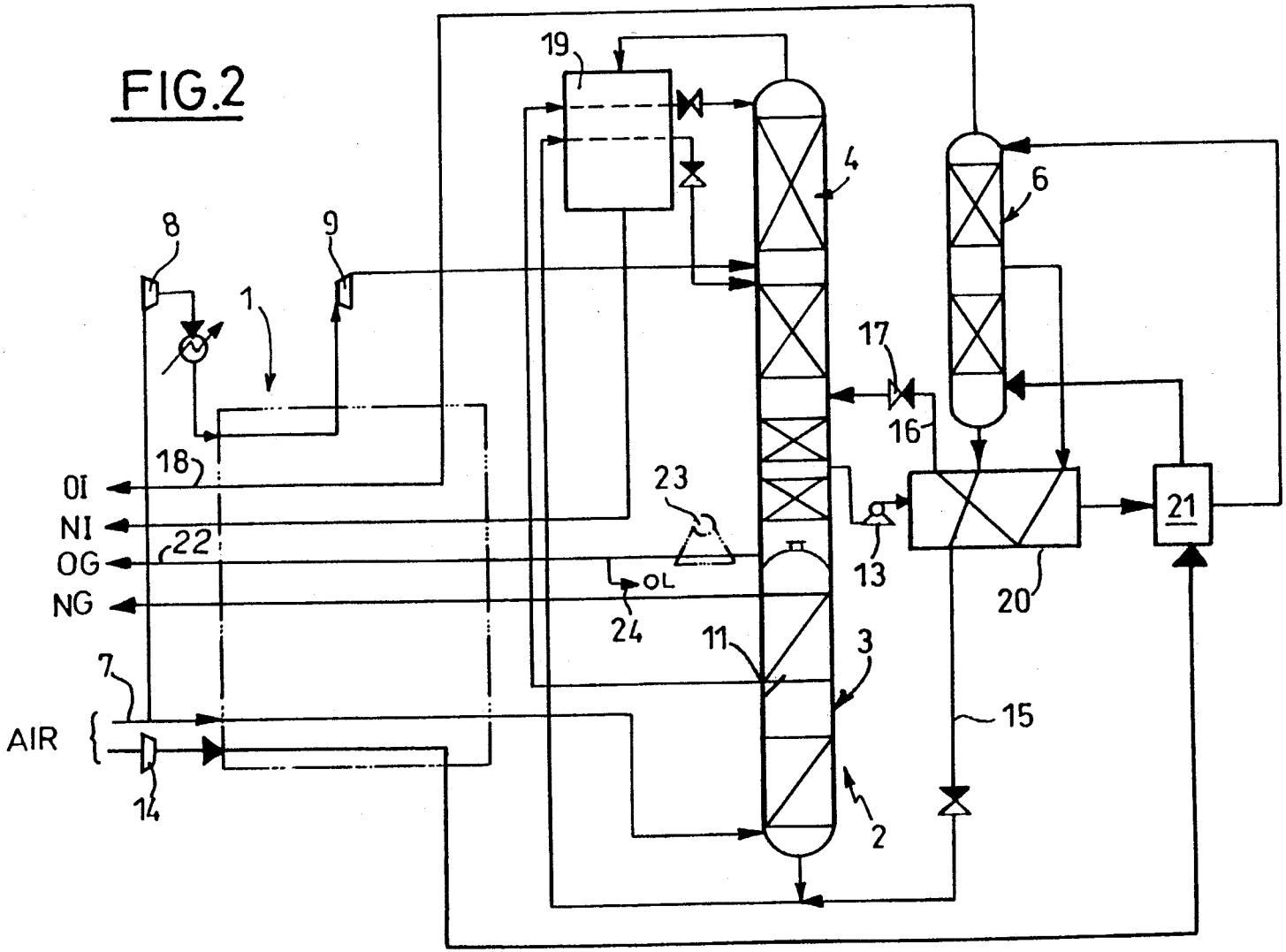

As illustrated in FIG. 2, another way of determining this degree of purity consists in choosing the level of withdrawal, in the low pressure column 4, of the liquid feeding column 6, for example by leaving a few distillation plates between the point of withdrawal and the bottom of column 4.

As also illustrated in FIG. 2, the apparatus may produce, at the same time as impure oxygen of column 6, oxygen of different purity and pressure, for example substantially pure oxygen, by withdrawing from the bottom of column 4. This oxygen may be supplied in gaseous form, via a duct 22 passing through heat exchange line 1, under the low pressure of the low pressure column 4 or under pressure, for example by pumping liquid at 23 before warming same in the exchange line; it may also be liquefied and sent to a storage 24.

Figure 3:
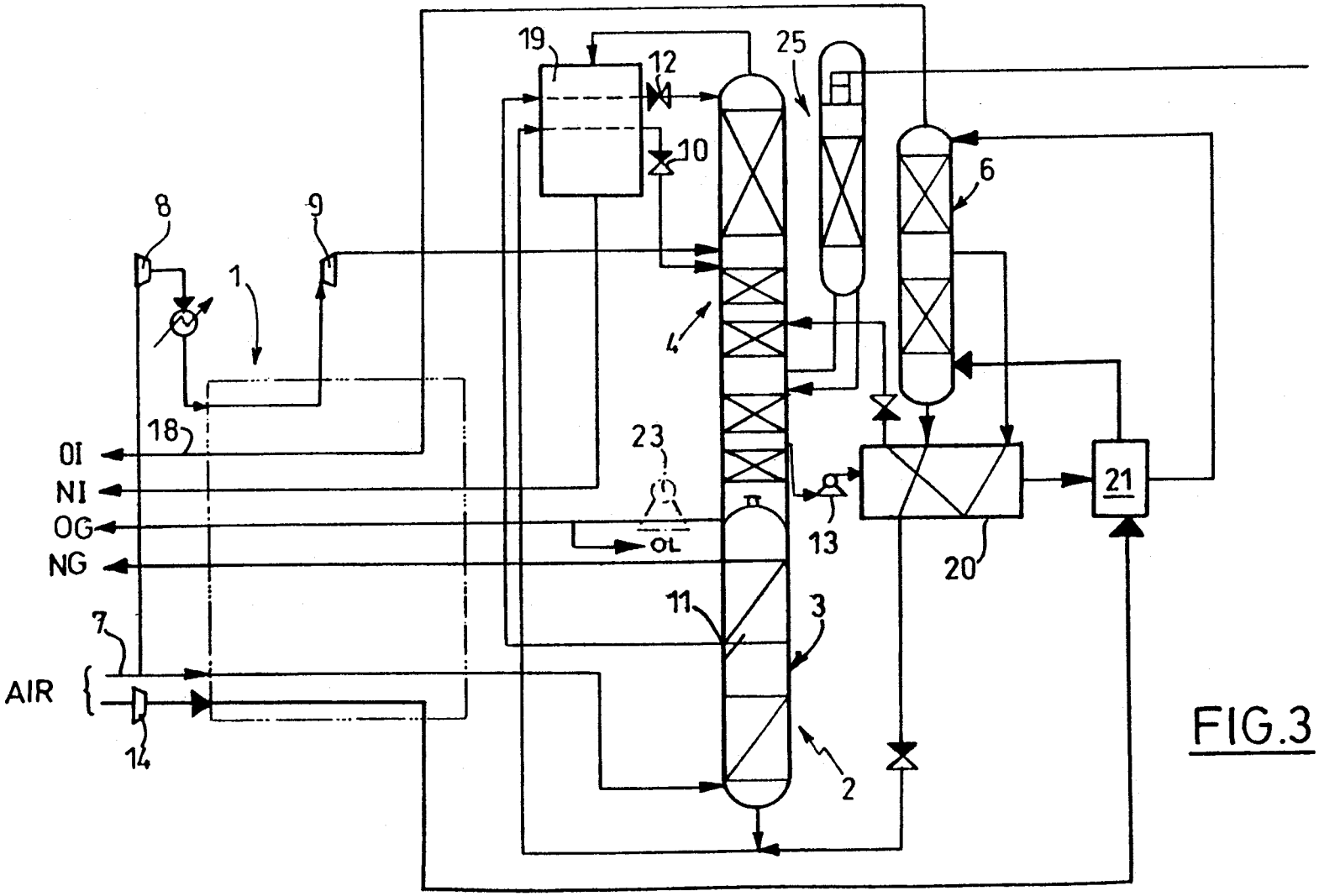

The apparatus of FIG. 3 differs from that of FIG. 2 in that it additionally comprises a column 25 for the production of impure argon which is combined, in known matter, with the low pressure column 4.

Indeed, the fact that impure oxygen is not produced by the low pressure column 4 but by the mixing column 6 enables to produce impure oxygen containing very little argon, which also makes it possible to produce argon, of course if the liquid oxygen withdrawn and pumped at 13 is sufficiently pure, for example at a purity of at least 98%.

The auxiliary air at pressure P1 may be atmospheric air suitably purified, but may also originate from an annexed process comprising an air compressor. It may for example consist of air withdrawn at the inlet of a gas turbine and whose pressure is possibly adjusted by means of a booster or an expansion turbine. More generally, to feed the bottom of mixing column 6, it is possible to use a mixture of air gases that is poorer in oxygen than the liquid withdrawn from the lower portion of the low pressure column, for example impure nitrogen possibly originating from the apparatus itself.

Thus, the invention enables to produce simultaneously, under particularly economical conditions of investment and energy consumption, pure or substantially pure oxygen, impure oxygen and argon.

It should be noted that the oxygen produced in column 4 is practically free of nitrogen and may therefore be used in converters of a steel mill. The apparatus, in the form illustrated in FIG. 2, thus enables to simultaneously feed these converters with pure oxygen and the blast furnace of the steel mill with impure oxygen at the pressure of the blast furnace; in the form illustrated in FIG. 3, the apparatus may additionally supply the steel mill with argon.

We claim:

1. Process for distilling air by means of a double distillation column coupled to a mixing column and comprised of a low pressure column and a mean pressure column pressurized to a first pressure, said process comprising the steps of:

feeding the mixing column with an auxiliary gas consisting of a mixture of air gases;

withdrawing a liquid which is richer in oxygen than said auxiliary gas from said low pressure column and introducing said liquid into said mixing column; and compressing each of said auxiliary gas and said liquid substantially to a same second pressure which differs from the first pressure of said mean pressure column.

2. The process according to claim 1, wherein said liquid is a liquid introduced into said mixing column from a lower section of said low pressure column.

3. The process according to claim 2, wherein said liquid is a liquid which is substantially free of nitrogen.

4. The process according to claim 2, wherein said liquid is withdrawn at least a few plates above the bottom of said low pressure column.

5. The process according to claim 1 wherein oxygen is withdrawn from a lower section of said low pressure column to define a second production gas.

6. The process according to claim 1 and further including the step of producing impure argon by means for an additional distillation column coupled to said low pressure column.

7. The process according to claim 1 wherein said auxiliary gas and said liquid are compressed to a pressure which is higher by at least $2\times10^5$ Pa than the pressure in said mean pressure column.

8. The process according to claim 7 wherein said auxiliary gas and said liquid are compressed to a pressure between $8\times10^5$ Pa and $16\times10^5$ Pa.

9. Apparatus for distilling air comprising a double distillation column including a mean pressure column pressurized to a first pressure and a low pressure column, a mixing column coupled to said doubled distillation column, a heat exchange line through which passes an auxiliary gas composed of a mixture of air gases prior to introduction of said auxiliary gas into said mixing column, means for withdrawing a liquid which is richer in oxygen than said auxiliary gas from said low pressure column and means for pumping said liquid and means for introducing said liquid into said mixing column to a second pressure to define a first production gas, means for compressing said auxiliary gas to a second pressure which differs from the first pressure of said mean pressure column, and wherein said pumping means pressurizes said liquid to said second pressure before introducing the same into said mixing column.

10. The apparatus of claim 9 wherein said liquid is a liquid introduced into said mixing column from a lower section of said low pressure column.

11. The apparatus of claim 10 wherein said liquid is withdrawn at least a few plates above the bottom of said low pressure column.

12. The apparatus of claim 9 and further including means for withdrawing oxygen at a lower section of said low pressure column as a second production gas of the apparatus.

13. The apparatus of claim 9 and further comprising an additional distillation column for the production of impure argon coupled to said low pressure column.

* * * * *